US009597775B2

(12) United States Patent
Vail

(10) Patent No.: US 9,597,775 B2
(45) Date of Patent: Mar. 21, 2017

(54) METHODS OF AT LEAST PARTIALLY REMOVING AT LEAST ONE INTERSTITIAL CONSTITUENT FROM A POLYCRYSTALLINE DIAMOND BODY USING A REMOVING AGENT INCLUDING A SUPERCRITICAL FLUID COMPONENT

(71) Applicant: US SYNTHETIC CORPORATION

(72) Inventor: Michael A. Vail, Genola, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 52 days.

(21) Appl. No.: 14/520,188

(22) Filed: Oct. 21, 2014

(65) Prior Publication Data

US 2016/0339561 A1 Nov. 24, 2016

Related U.S. Application Data

(60) Provisional application No. 61/897,764, filed on Oct. 30, 2013.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |
| ***B24D 3/10*** | (2006.01) |

(52) U.S. Cl.

CPC ..... *B24D 3/10* (2013.01)

(58) Field of Classification Search

USPC ..... 51/293, 296, 307

See application file for complete search history.

(56) References Cited

U.S. PATENT DOCUMENTS

| | | | |
|---|---|---|---|
| 4,475,993 | A | 10/1984 | Blander et al. |
| 5,225,173 | A | 7/1993 | Wai |
| 5,274,129 | A | 12/1993 | Natale et al. |
| 5,356,538 | A | 10/1994 | Wai et al. |

(Continued)

OTHER PUBLICATIONS

U.S. Appl. No. 13/027,954, filed Feb. 15, 2011, Miess et al.

(Continued)

*Primary Examiner* — James McDonough

(74) *Attorney, Agent, or Firm* — Dorsey & Whitney LLP

(57) ABSTRACT

Embodiments relate to methods of fabricating polycrystalline diamond compacts ("PDCs") in which a removing agent includes at least one supercritical fluid component that is used to remove at least one interstitial constituent from at least a portion of a polycrystalline diamond ("PCD") body and applications for such PDCs. Removing the at least one interstitial constituent using the removing agent including the at least one supercritical fluid component may provide more rapid and effective removal of the at least one interstitial constituent from a PCD body than conventional acid leaching. In an embodiment, a method of fabricating at least partially porous PCD body includes providing a PCD body in which at least one interstitial constituent is disposed throughout, and removing at least a portion of the at least one interstitial constituent from the PCD body with a removing agent including at least one supercritical fluid component.

26 Claims, 10 Drawing Sheets

(56) References Cited

U.S. PATENT DOCUMENTS

| | | | | |
|---|---|---|---|---|
| 5,606,724 | A | 2/1997 | Wai et al. | |
| 5,730,874 | A | 3/1998 | Wai et al. | |
| 5,770,085 | A | 6/1998 | Wai et al. | |
| 5,792,357 | A | 8/1998 | Wai et al. | |
| 5,840,193 | A | 11/1998 | Smart et al. | |
| 5,965,025 | A | 10/1999 | Wai et al. | |
| 6,075,130 | A | 6/2000 | Chen et al. | |
| 6,117,413 | A | 9/2000 | Fisher et al. | |
| 6,132,491 | A | 10/2000 | Wai et al. | |
| 6,187,911 | B1 | 2/2001 | Wai et al. | |
| 6,524,628 | B1 | 2/2003 | Wai et al. | |
| 6,653,236 | B2 | 11/2003 | Wai et al. | |
| 7,128,840 | B2 | 10/2006 | Wai et al. | |
| 7,341,947 | B2 | 3/2008 | Wai et al. | |
| 7,400,043 | B2 * | 7/2008 | Wai | C23C 18/48 257/751 |
| 7,423,345 | B2 * | 9/2008 | Wai | C23C 18/48 257/751 |
| 7,582,561 | B2 | 9/2009 | Wai et al. | |
| 7,686,865 | B2 | 3/2010 | Wai et al. | |
| 7,845,438 | B1 * | 12/2010 | Vail | C22C 26/00 175/426 |
| 7,866,418 | B2 | 1/2011 | Bertagnolli et al. | |
| 7,897,517 | B2 | 3/2011 | Wai et al. | |
| 8,236,074 | B1 * | 8/2012 | Bertagnolli | B24D 99/005 175/420.2 |
| 8,596,387 | B1 | 12/2013 | Sani et al. | |

OTHER PUBLICATIONS

U.S. Appl. No. 13/585,196, filed Aug. 14, 2012, Gleason et al.
U.S. Appl. No. 61/897,764, filed Oct. 30, 2013, Vail.
U.S. Appl. No. 62/062,553, filed Oct. 10, 2014, Heaton et al.
Kersch et al. "Supercritical Fluid Extraction of Heavy Metals from Fly Ash" Ind. Eng. Chem. Res. 2004, 43, 190-196.
Saji et al. "Supercritical fluid extraction of cobalt" Indian Journal of Chemistry, vol. 42A, Dec. 2003, pp. 3017-3020.
Tian et al. "Metal Ions Extraction from Solid Matrix in Supercritical Carbon Dioxide with DMBP as Chelating Ligand" CLEAN—Soil, Air, Water 2010, 38 (5-6), 543-547.
Wang et al. "Metal extraction from solid matrices using two-surfactant microemulsion in neat supercritical carbon dioxide" Microchim Acta (2009) 167: 61-65.

* cited by examiner

METHODS OF AT LEAST PARTIALLY REMOVING AT LEAST ONE INTERSTITIAL CONSTITUENT FROM A POLYCRYSTALLINE DIAMOND BODY USING A REMOVING AGENT INCLUDING A SUPERCRITICAL FLUID COMPONENT

CROSS-REFERENCE TO RELATED APPLICATIONS

This application claims priority to U.S. Provisional Application No. 61/897,764 filed on 30 Oct. 2013, the disclosure of which is incorporated herein, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer (also known as a diamond table). The diamond table is formed and bonded to a substrate using an ultra-high pressure, ultra-high temperature ("HPHT") process. The PDC cutting element may also be brazed directly into a preformed pocket, socket, or other receptacle formed in the bit body. The substrate may be often brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented-carbide substrate into a container or cartridge with a volume of diamond particles positioned adjacent to a surface of the cemented-carbide substrate. A number of such cartridges may be loaded into an HPHT press. The substrates and volume of diamond particles are then processed under HPHT conditions in the presence of a catalyst that causes the diamond particles to bond to one another to form a matrix of bonded diamond grains defining a polycrystalline diamond ("PCD") table. The catalyst is often a metal-solvent catalyst, such as cobalt, nickel, iron, or alloys thereof that is used for promoting intergrowth of the diamond particles.

In one conventional approach for forming a PDC, a constituent of the cemented-carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a solvent catalyst to promote intergrowth between the diamond particles, which results in formation of bonded diamond grains. A solvent catalyst may be mixed with the diamond particles prior to subjecting the diamond particles and substrate to the HPHT process.

In another conventional approach for forming a PDC, a sintered PCD table may be separately formed and then leached to remove solvent catalyst from interstitial regions between bonded diamond grains. The leached PCD table may be simultaneously HPHT bonded to a substrate and infiltrated with a non-catalyst material, such as silicon, in a separate HPHT process. The non-catalyst material may infiltrate the interstitial regions of the sintered PCD table from which the solvent catalyst has been leached.

Despite the availability of a number of different PCD materials, manufacturers and users of PCD materials continue to seek PCD materials that exhibit improved toughness, wear resistance, and/or thermal stability.

SUMMARY

Embodiments of the invention relate to methods of fabricating at least partially porous PCD bodies and PDCs in which a removing agent including at least a supercritical fluid component is used to at least partially remove at least one interstitial constituent (e.g., at least one of a catalyst or metallic infiltrant) from at least a portion of a PCD body, resultant PCD bodies and PDCs, and applications for such PCD bodies and PDCs. Removing the at least one interstitial constituent using the removing agent including the at least one supercritical fluid component may provide more rapid and effective removal of at least one of the catalyst or metallic infiltrant from a PCD body than acid leaching.

In an embodiment, a method of fabricating an at least partially porous PCD table includes providing a PCD body including a plurality of bonded diamond grains defining a plurality of interstitial regions in which at least one interstitial constituent (e.g., at least one of a catalyst or metallic infiltrant) is disposed. The method further includes removing at least a portion of the at least one interstitial constituent from the PCD body using a removing agent. The removing agent includes at least at least one supercritical fluid component. In an embodiment, prior to removing at least a portion of the at least one interstitial constituent, the PCD body may be integrally formed with a substrate to which the PCD body is bonded as a PCD body. In another embodiment, prior to removing at least a portion of the at least one interstitial constituent, the PCD table may be preformed and bonded to a substrate in an HPHT process.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to methods of fabricating PCD bodies and PDCs in which a removing agent including at least one supercritical fluid component is used to remove at least one interstitial constituent (e.g., at least one of a catalyst or a metallic infiltrant) from at least a portion of a PCD table to form at least partially porous PCD table, resultant PCD bodies and PDCs, and applications for such PCD bodies and PDCs. Removing the at least one interstitial constituent using the removing agent including the at least one supercritical fluid component may provide more rapid and effective removal of the at least one interstitial constituent from a PCD table than conventional acid leaching. The PDC embodiments disclosed herein may be used in a variety of applications, such as rotary drill bits, bearing apparatuses, wire-drawing dies, machining equipment, and other articles and apparatuses. A supercritical fluid component is any substance at a temperature and a pressure above its critical point, where distinct liquid and gas phases do not exist. A supercritical fluid component can effuse through porous materials like a gas, and have mass transport properties like a liquid.

FIGS. 1A-1J are cross-sectional views illustrating different stages in a method of fabricating a PDC according to an embodiment that includes forming a PCD table from a plurality of diamond particles and a catalyst in a first HPHT process and at least partially removing a catalyst from the PCD table so-formed by exposing the PCD table to a removing agent that includes at least one supercritical fluid component. A PDC is formed by bonding the at least partially porous PCD table to a substrate in a second HPHT process, which infiltrates the at least partially porous PCD table with a metallic infiltrant. The PDC so-formed may be subsequently shaped to provide a peripherally-extending chamfer. Finally, a working surface of the PCD table may have at least some of the metallic infiltrant removed therefrom using a removing agent containing a supercritical fluid. Such a method may provide for more rapid and effective removal of the catalyst and/or metallic infiltrant from the PCD table before and/or after bonding to the substrate than conventional acid leaching.

Figure 1A:
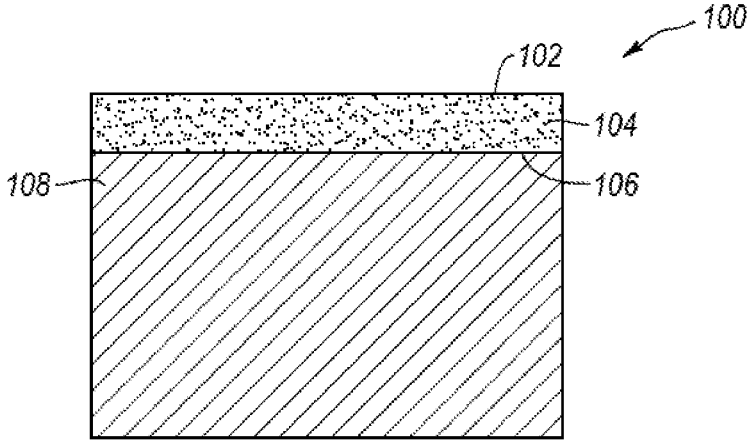
FIGS. 1A-1J are cross-sectional views illustrating different stages in a method of fabricating a PDC in which a removing agent including at least one supercritical fluid component is used for leaching a PCD table according to an embodiment.
Figure 1B:
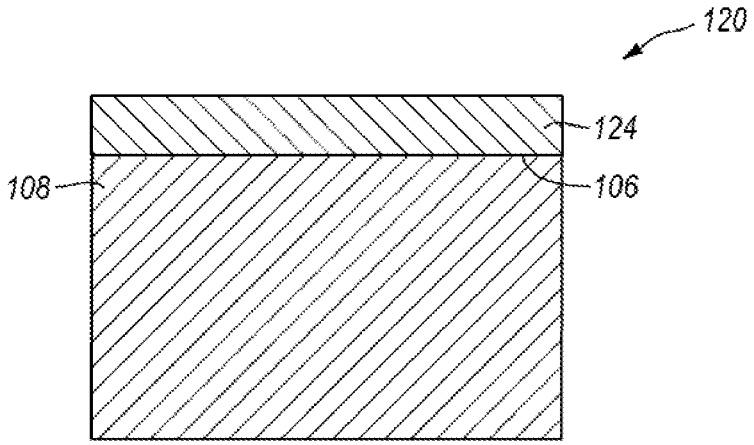

Referring to FIG. 1A, a cross-sectional view of an assembly 100 is illustrated in which a plurality of diamond particles 104 are placed adjacent to a substrate 108. A PCD table 124 as shown in FIG. 1B may be fabricated by subjecting the assembly 100 including the plurality of diamond particles 104 (e.g., diamond particles having an average particle size between 0.5 μm to about 150 μm) and the substrate 108 to an HPHT sintering process in the presence of a catalyst. The catalyst includes a metal-solvent catalyst (e.g., cobalt, nickel, iron), a carbonate catalyst (e.g., alkali metal carbonates or alkaline earth metal carbonates), an alloy of any of the preceding metals, or a combination of the preceding catalysts. The catalyst facilitates intergrowth between the diamond particles 104 and forms the PCD table 124 comprising directly bonded-together diamond grains (e.g., exhibiting $sp^3$ bonding) defining interstitial regions with the catalyst disposed within at least a portion of the interstitial regions.

In order to effectively HPHT sinter the plurality of diamond particles 104, the assembly 100, shown in FIG. 1A, may be placed in a pressure transmitting medium, such as a refractory metal can, graphite structure, pyrophyllite or other pressure transmitting structure, or another suitable container or supporting element. The pressure transmitting medium, including the assembly 100, may be subjected to an HPHT process using an HPHT press at a temperature of at least about 1000° C. (e.g., about 1300° C. to about 1600° C.) and a cell pressure of at least 4 GPa (e.g., about 5 GPa to about 10 GPa, about 7 GPa to about 9 GPa) for a time sufficient to sinter the diamond particles 104 and form a PCD table 124 that bonds to the substrate 108.

In the illustrated embodiment, the PCD table 124 is formed by sintering the diamond particles 104 on the substrate 108, which may be a cobalt-cemented tungsten carbide substrate from which cobalt or a cobalt alloy infiltrates into the diamond particles 104 and catalyzes formation of PCD. For example, the substrate 108 may comprise a cemented carbide material, such as a cobalt-cemented tungsten carbide material or another suitable material. For example, nickel, iron, and alloys thereof are other catalysts that may form part of the substrate 108. Other materials for the substrate 108 include, without limitation, cemented carbides including titanium carbide, niobium carbide, tantalum carbide, vanadium carbide, and combinations of any of the preceding carbides cemented with iron, nickel, cobalt, or alloys thereof. However, in other embodiments, the substrate 108 may be replaced with a catalyst material disc and/or catalyst particles may be mixed with the diamond particles 104. As discussed above, in other embodiments, the catalyst may be a carbonate catalyst selected from one or more alkali metal carbonates (e.g., one or more carbonates of Li, Na, and K), one or more alkaline earth metal carbonates (e.g., one or more carbonates of Be, Mg, Ca, Sr, and Ba), or combinations of the foregoing. The carbonate catalyst may be partially or substantially completely converted to a corresponding oxide of Li, Na, K, Be, Mg, Ca, Sr, Ba, or combinations after HPHT sintering of the plurality of diamond particles 104.

The diamond particle size distribution of the plurality of diamond particles 104 may exhibit a single mode, or may be a bimodal or greater grain size distribution. In an embodiment, the diamond particles 104 may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles 104 may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles 104 may include a portion exhibiting a relatively larger average particle size between about 10 μm and about 40 μm and another portion exhibiting a relatively smaller average particle size between about 1 μm and 4 μm. In some embodiments, the diamond particles 104 may comprise three or more different average particle sizes (e.g., one relatively larger average particle size and two or more relatively smaller average particle sizes), without limitation.

FIG. 1B illustrates a cross-sectional view of a PDC 120 formed by HPHT processing of the assembly 100 shown in FIG. 1A. In such an embodiment, the PCD table 124 so-formed may include tungsten and/or tungsten carbide that is swept in with the catalyst from the substrate 108. For example, some tungsten and/or tungsten carbide from the substrate 108 may be dissolved or otherwise transferred by the liquefied catalyst (e.g., cobalt from a cobalt-cemented tungsten carbide substrate) from the substrate 108 that sweeps into the diamond particles 104. The PCD table 124 includes a plurality of directly bonded-together diamond grains exhibiting diamond-to-diamond bonding therebetween defining interstitial regions with the catalyst disposed within at least a portion of the interstitial regions. The PCD table 124 also becomes metallurgically bonded to the substrate 108 during HPHT processing of the assembly 100. In an embodiment, the sintered diamond grains of the PCD table 124 may exhibit an average grain size of about 20 μm or less.

More details about the manner in which the PDC 120 or the PCD table 124 may be formed may be found in U.S. Pat. No. 7,866,418, which is incorporated herein, in its entirety, by this reference. U.S. Pat. No. 7,866,418 discloses various embodiments for fabricating PCD and PDCs at ultra-high cell pressures. For example, PCD sintered at a cell pressure of at least about 7.5 GPa may exhibit a coercivity of 115 Oe or more, a high-degree of diamond-to-diamond bonding, a specific magnetic saturation of about 15 $G \cdot cm^3/g$ or less, and a metal-solvent catalyst content of about 7.5 weight % ("wt %") or less, such as about 1 wt % to about 6 wt %, about 1 wt % to about 3 wt %, or about 3 wt % to about 6 wt %. Generally, as the sintering cell pressure that is used to form the PCD increases, the coercivity may increase and the magnetic saturation may decrease. The PCD defined collectively by the bonded diamond grains and the catalyst may exhibit a coercivity of about 115 Oe or more and a metal-solvent catalyst content of less than about 7.5 wt % (e.g., as may be indicated by a specific magnetic saturation of about 15 $G \cdot cm^3/g$ or less). In a more detailed embodiment, the coercivity of the PCD may be about 115 Oe to about 250 Oe and the specific magnetic saturation of the PCD may be greater than 0 $G \cdot cm^3/g$ to about 15 $G \cdot cm^3/g$. In an even more detailed embodiment, the coercivity of the PCD may be about 115 Oe to about 175 Oe and the specific magnetic saturation of the PCD may be about 5 $G \cdot cm^3/g$ to about 15 $G \cdot cm^3/g$. In yet an even more detailed embodiment, the coercivity of the PCD may be about 155 Oe to about 175 Oe and the specific magnetic saturation of the PCD may be about 10 $G \cdot cm^3/g$ to about 15 $G \cdot cm^3/g$. The specific permeability (i.e., the ratio of specific magnetic saturation to coercivity) of the PCD may be about 0.10 or less, such as about 0.060 to about 0.090. Despite the average grain size of the bonded diamond grains being less than about 30 μm in some embodiments, the catalyst content in the PCD may be less than about 7.5 wt % resulting in a desirable thermal stability.

Figure 1C:
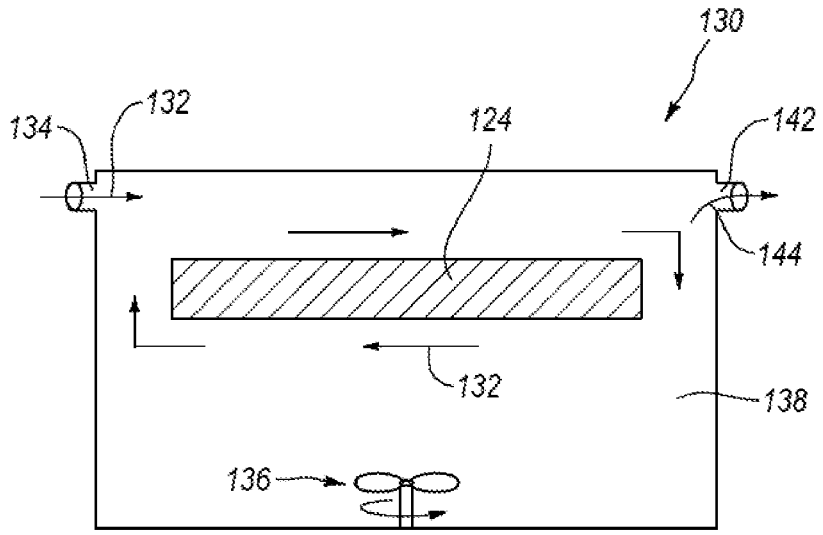
Figure 1D:
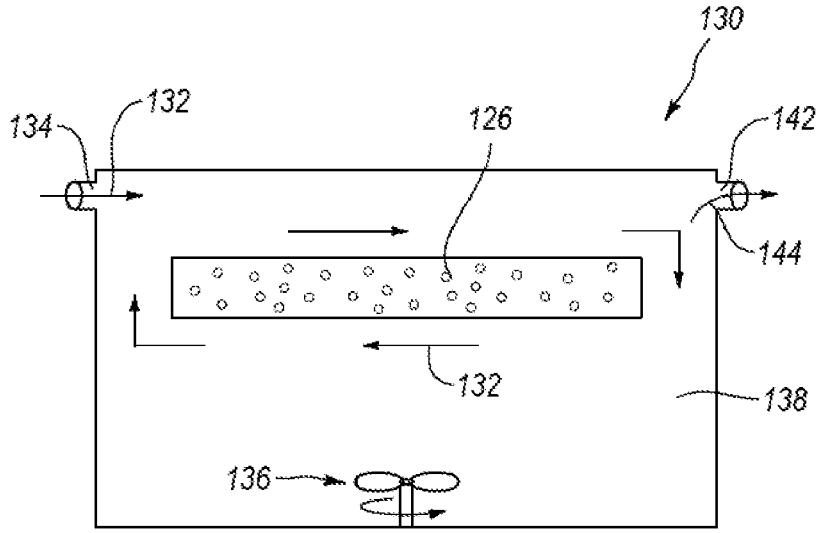

The PCD table 124, shown in FIG. 1B, may be separated from the substrate 108 or catalyst material disk using a lapping process, a grinding process, wire-electrical-discharge machining ("wire EDM"), combinations thereof, or another suitable material-removal process. As shown in FIG. 1C, the separated PCD table 124 may be enclosed in a suitable extraction apparatus 130 and a flow of a removing agent 132 may be provided that is selected to remove at least a portion of a catalyst and/or metallic infiltrant from the interstitial regions of the separated PCD table 124 to form an at least partially porous PCD table 126 (FIG. 1D). The extraction apparatus 130 may be a closed system (e.g., the removal agent 132 remains in the system) or an open system (e.g., the removal agent 132 is passing in and out of the system).

The removing agent 132 includes at least one supercritical fluid and has many advantages for the removal of a catalyst and/or metallic infiltrant from PCD bodies over an acid and a gaseous leaching agent including enhanced diffusivity, lower viscosity, chemical stability, and pressure-dependent solvation properties that facilitate removal of the catalyst or metallic infiltrant. The at least one supercritical fluid component may also exhibit substantially zero surface tension, which is beneficial for extraction of catalyst or metallic infiltrant from PCD bodies because the at least one supercritical fluid component may more readily penetrate into the interstitial regions between the bonded diamond grains of the PCD table. These features of the at least one supercritical fluid component may be exploited to remove catalyst or metallic infiltrant from the interstitial regions of the PCD bodies and PDCs, and to provide for shorter removal cycles and faster removal rates compared to a conventional acid leaching process. Removing a catalyst or metallic infiltrant from the interstitial regions using the at least one supercritical fluid component may be particularly effective for leaching PCD bodies fabricated at ultra-high cell pressures that exhibit a relatively high-degree of diamond-to-diamond bonding as described in U.S. Pat. No. 7,866,418. For example, it is currently believed by the inventor that employing the removing agents disclosed herein including at least one supercritical fluid component may improve removal rates by as much as a factor of about 8 to about 10.

In an embodiment, the removing agent 132 may be a leaching agent. The leaching agent includes one or more supercritical fluid components, one or more aqueous components, and optionally one or more chelating agents. The aqueous component functions to dissolve the catalyst or metallic infiltrant in solution as metal ions (e.g., cobalt ions). In an embodiment, the one or more supercritical fluid components are the one or more aqueous components (i.e., the components may be the same). When present, the chelating agent functions to dissolve and/or bind to the metal ions, which ordinarily are not very soluble in the supercritical fluid component, into the supercritical fluid component. In an embodiment, the supercritical fluid component includes supercritical carbon dioxide, supercritical water, or combinations thereof and the aqueous component includes hydrofluoric acid, nitric acid, hydrochloric acid, aqua regia, or combinations thereof. In an embodiment, the supercritical fluid component may include a supercritical organic solvent, supercritical water, supercritical methane, supercritical ethane, supercritical propane, supercritical ethylene, supercritical propylene, supercritical methanol, supercritical ethanol, supercritical acetone, supercritical pentane, supercritical butane, supercritical hexamine, supercritical heptane, supercritical sulfur hexafluoride, supercritical xenon dichlorodifluoromethane, supercritical trifluoromethane, supercritical isopropanol, supercritical nitrous oxide, supercritical ammonia, supercritical methylamine, supercritical diethyl ether, or combinations thereof.

According to various embodiments, the supercritical component may comprise about 5 wt % to about 60 wt % (e.g., about 10 wt % to about 30 wt %, about 15 wt % to about 20 wt %, about 30 wt % to about 60 wt %), the aqueous component may comprise about 5 wt % to about 60 wt % (e.g., about 10 wt % to about 30 wt %, about 15 wt % to about 20 wt %, about 30 wt % to about 60 wt %), and the optional chelating agent may comprise about 5 wt % to about 60 wt % (e.g., about 10 wt % to about 30 wt %, about 15 wt % to about 20 wt %, about 30 wt % to about 60 wt %) of the removing agent. The removing agent may comprise any combinations of any of the supercritical components, aqueous components, and chelating agents disclosed herein along with any combination of the weight percent ranges disclosed above.

As discussed above, one or more chelating agents may be added to the removing agent 132 in order to facilitate the solubility of the metal ions from the catalyst or metallic infiltrant in the supercritical fluid component. At least a portion of the chelating agent may also act as surfactant to aid the formation of an emulsion or microemulsion supercritical fluid. The resulting microemulsion exhibiting polar metal or catalyst ions in water cores substantially disperses in the supercritical fluid component making the emulsion supercritical fluid an effective medium for the removal of metallic infiltrant or catalyst from PCD bodies. In some embodiments, the chelating agent may be an amphiphilic surfactant or an organic solvent. In another embodiment, the chelating agent may include at least one of a dithiocarbamate, 2-ethyl hexyl 2-ethyl hexyl phosphonic acid, a 2-ethyl sodium bis-(2-ethyl hexyl)sulfosuccinate, crown ethers, β-diketones, fluorinated deketones; a fluorinated sodium bis-(2-ethyl hexyl)sulfosuccinate, a 2,2'-bipyridine and its derivatives (e.g., 4,4'-dimehtyl-2,2'-bipyridyl), a phosphate such as a perfluoropolyether phosphate, a fluorinated surfactant including a fluorocarbon tail, or a surfactant including a low density of polarizability. In another embodiment, the chelating agent may contain an additive that aids the leaching process such as perfluoro-1-octane-sulfonic acid tetraethylammonium salt. In a more specific embodiment, the removing agent includes a microemulsion of supercritical carbon dioxide, water, sodium bis-(2-ethylhexyl)sulfosuccinate, and perfluoropolyether phosphate. In an embodiment, the removing agent may include supercritical carbon dioxide and either a β-diketone, a dithiocarbamates, a phosphate or a crown ether as the chelating agent. In an embodiment, when the supercritical fluid component is supercritical water, the removing agent may be substantially free of the chelating agent as the metal ions are soluble in the supercritical water.

In an embodiment, the removing agent 132 may be prepared by stirring or mixing the supercritical fluid component and the chelating agent sufficiently to form an emulsion. The emulsification may occur following a period of stirring. For example, the emulsification may occur following stirring for a time of less than about 2 hours, less than about 1.5 hours, from about 15 minutes to about 1 hour, from about 20 minutes to about 40 minutes, from about 25 to about 35 minutes, or for greater than 20 minutes. The stirring of the supercritical fluid component and the chelating agent may provide for a substantially homogeneously dispersed emulsion.

Referring again to FIG. 1C, the separated PCD table 124 may be placed in the extraction apparatus 130, and the removing agent 132 may be provided via an entry valve 134 into the interior chamber 138 of the extraction apparatus 130. The extraction apparatus may include one or more entry valves 134 (e.g., two or more entry valves). The removing agent 132 may be emulsified by a stirring and mixing action of the stir bar 136. The extraction apparatus 130 containing the emulsified removing agent 132 and the PCD table 124 may subsequently be heated and pressurized (via a pump that is not shown) under conditions effective so that the supercritical fluid component is in its supercritical state. Under these pressure and temperature conditions, the supercritical fluid component is in its supercritical state and the other components (the aqueous component and/or the chelating agent) are maintained below their respective boiling points which is a function of both temperature and pressure. The emulsified removing agent 132 at least partially removes the catalyst from the PCD table 124, thereby forming the at least partially porous PCD table 126, as shown in FIG. 1D. The catalyst, solubilized in the emulsified removing agent 144, may be optionally removed from the extraction apparatus via the exit valve 142.

According to various embodiments, the removing agent may be provided via the entry valve 134 at a flow rate of about 0.001 ml/min to about 100 ml/min. For example, the flow rate of the removing agent may be about 0.01 ml/min to about 10 ml/min, about 0.01 ml/min to about 0.1 ml/min, about 0.1 ml/min to about 1.0 ml/min, or about 1.0 ml/min to about 10 ml/min. In another embodiment, the flow rate of the removing agent into the extraction apparatus may be based on the size of the extraction apparatus. For example, the flow rate may be about 0.00001 ml/min to about 1.0 ml/min for every ml within the extraction apparatus (e.g., about 0.00001 ml/min to about 0.001 ml/min, about 0.001 ml/min to about 1.0 ml/min). In this example, the flow rate of the removing agent into a 100 ml extraction apparatus may be about 0.01 ml/min to about 100 ml/min.

In another embodiment, the metallic infiltrant and/or catalyst occupying the interstitial regions of the PCD table is removed using a flow of at least one supercritical fluid that is substantially free of any leaching agent or other aqueous component in combination with an electrochemical process. In this embodiment, the removing agent 132 includes at least one supercritical fluid component and at least one chelating agent, as previously described in any of the disclosed embodiments. The PCD table 124 to be treated is immersed in an electrolyte component, which includes free ions that can act as the carriers of an electric current. Additionally, the electrolyte component is not significantly oxidized or reduced during the electrochemical process. An example of an electrolyte may be a sulfate (e.g., $NiSO_4$ and/or $CoSO_4$ dissolved in a solvent), a nitrate (e.g., cobalt(II) nitrate), a chloride, an acid (e.g., hydrochloric acid, nitric acid, aqua regia, hydrofluoric acid, or combinations thereof), or any other suitable solvent. Additionally, the extraction apparatus includes a cathode, an electrical connection configured to be electrically coupled to the PCD table 124 and an electrical power source (e.g., a DC or an AC voltage source) electrically coupled to the cathode and the electrical connection.

In this embodiment, the PCD table 124 is electrically connected to the electrical connection. The removing agent 132 may be provided via the entry valve 134 into the interior chamber 138 of the extraction apparatus 130. The extraction apparatus 130 containing the removing agent and the PCD table 124 may subsequently be heated and pressurized under conditions effective so that the supercritical fluid component is in a supercritical state. Under these pressure and temperature conditions, the supercritical fluid component is in the supercritical state. Optionally, the electrolyte component may be maintained at a temperature below its respective boiling point at atmospheric pressure. The electrical power source applies a suitable voltage between the cathode and the PCD table 124 such that the PCD table 124 becomes an anode and an electrical current passes through the electrolyte component so that electrolysis takes place. In an embodiment, the voltage between the cathode and the anode is less than about 2.0 volts, less than about 1.75 volts, between about 2.0 volts and about 3 volts, or greater than 3 volts.

During the electrochemical process, the catalyst and/or metallic infiltrant in the PCD table 124 dissolves forming metallic ions that go into solution. Substantially simultaneously or after the voltage is applied and/or maintained, a flow of the removing agent 132 flows into the interior chamber 138 of the extraction apparatus 130 via the entry valve 134. Positive metallic ions from the catalyst and/or metallic infiltrant in the PCD table 124 generated during the electrochemical process are attracted to and bind to the at least one chelating agent of the flowing removing agent 132. The flow of the removing agent 132 including the at least one chelating agent and the at least one supercritical fluid component flows and effuses at least partially through the PCD table 124 carrying the metallic ions therewith that bind to the at least one chelating agent away from the PCD table 124 and out of the exit valve 144 to form the at least partially porous PCD table 124, thereby promoting removal of the catalyst and/or metallic infiltrant in the PCD table 124. Examples of electrochemical leaching and masking are disclosed in U.S. Provisional Application No. 62/062,553, the disclosure of which is incorporated herein, in its entirety, by this reference.

In an embodiment, a temperature for heating all of the contents in the extraction apparatus 130 may be about 31° C. with a pressure of about 1100 psi to facilitate removal of the metal and catalyst from the PCD table 124. In other embodiments, temperatures for heating all of the contents in the extraction apparatus 130 to facilitate removal of the catalyst from the PCD table 124 may be less than about 60° C., about 10° C. to about 50° C., about 20° C. to about 40° C., or about 25° C. to about 35° C. In another embodiment, the temperatures for heating all of the contents in the extraction apparatus 130 to facilitate removal of the catalyst from the PCD table 124 may be less than about 400° C., about 250° C. to about 375° C.; 200° C. to about 250° C.; about 100° C. to about 200° C., or about 60° C. to about 100° C. In an embodiment, pressures used for pressurizing the extraction apparatus 130 to facilitate removal of the catalyst from the PCD table 124 may include pressure less than about 3500 psi, about 3200 psi to about 3400 psi, about 500 psi to about 2000 psi, about 750 psi to about 1500 psi, about 900 to about 1200 psi, or about 1000 psi to about 1150 psi. For example, when the supercritical component includes water, the temperature may be at least about 375° C. and the pressure may be at least about 3200 psi. For example, when the supercritical component includes carbon dioxide, the temperature may be at least about 35° C. and the pressure may be at least about 1000 psi.

Figure 1E:
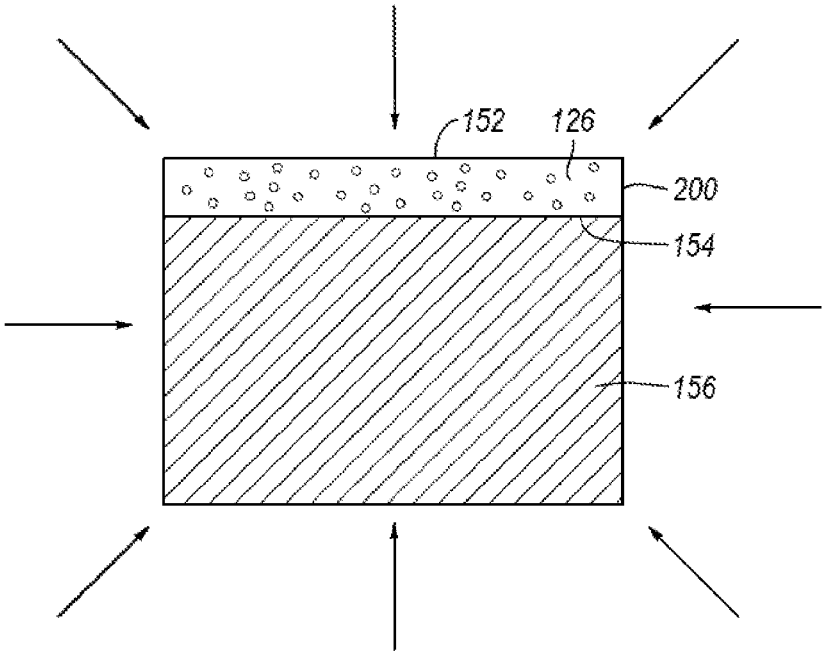

FIG. 1E illustrates a cross-sectional view of an assembly of a PCD table that has at least a portion of the catalyst or metallic infiltrant removed therefrom 126 (i.e., the at least partially porous PCD table) and a substrate 156. For example, the substrate 156 may be made from the same materials as the substrate 108 discussed above. The at least partially porous PCD table 126 includes a first surface 152 and an opposing second interfacial surface 154. The at least partially porous PCD table 126 includes a plurality of interstitial regions that were previously occupied by the catalyst and form a network of at least partially interconnected pores that extend between the first surface 152 and the second interfacial surface 154. The at least partially interconnected pores may enable fluid to flow from the first surface 152 to the second interface surface 154.

Figure 1F:
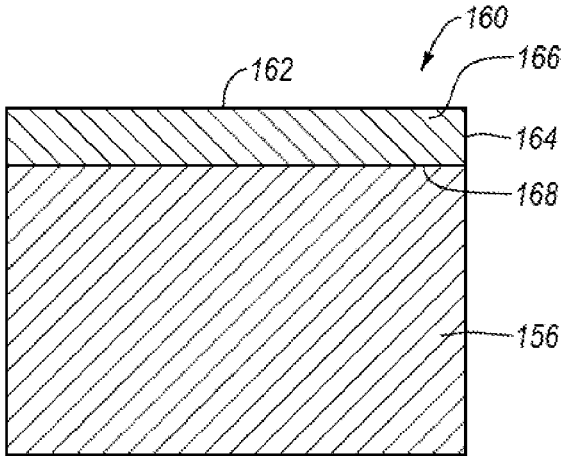

The assembly, shown in FIG. 1E, of the at least partially porous PCD table 126 and substrate 156 may be placed in a pressure transmitting medium, such as a refractory metal can, graphite structure, pyrophyllite or other pressure transmitting structure, or another suitable container or supporting element. The pressure transmitting medium, including the assembly, may be subjected to an HPHT process using an HPHT press at a temperature of at least about 1000° C. (e.g., about 1300° C. to about 1600° C.) and a cell pressure of at least 4 GPa (e.g., about 5 GPa to about 10 GPa, about 7 GPa to about 9 GPa) for a time sufficient to bond the porous PCD table 126 to the substrate 156 and form a PDC 160 as shown in FIG. 1F. The HPHT process bonds the at least partially porous PCD table 126 to the substrate 156 and may cause metallic infiltrant from the substrate 156 or another source to infiltrate the interstitial regions of the at least partially porous PCD table 126. The HPHT temperature may be sufficient to melt at least one constituent of the substrate 156 (e.g., cobalt, nickel, iron, alloys thereof, or another constituent) that infiltrates the at least partially porous PCD table 126. The PDC 160 so-formed includes an infiltrated PCD table 166 in which the interstitial regions thereof are at least partially filled with the metallic infiltrant from the substrate 156. It is noted that the PDC 160 may exhibit other geometries than the geometry illustrated in FIG. 1F. For example, the PDC 160 may exhibit a non-cylindrical geometry. Other HPHT processes, cleaning processes, and resultant PDCs may be formed according to other techniques as disclosed in U.S. patent application Ser. No. 13/027,954 and U.S. Pat. Nos. 7,845,438 and 8,236,074, which are incorporated herein, in their entirety, by this reference.

Figure 1G:
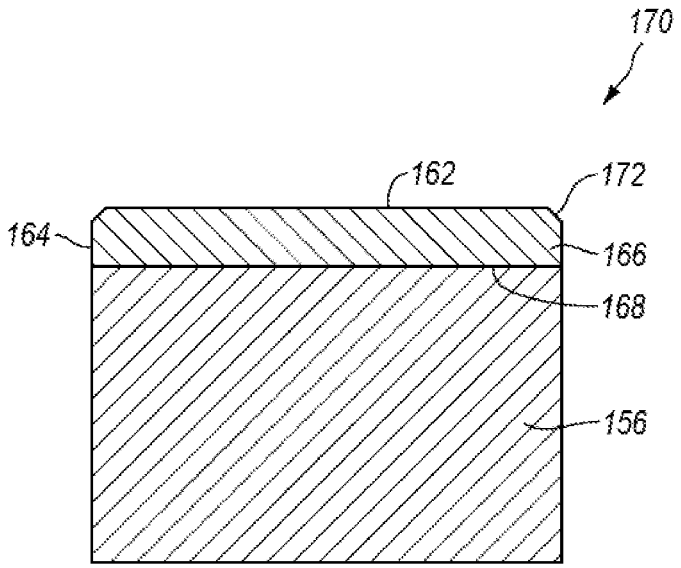

In some embodiments, the PDC 160 so-formed may be subjected to a number of different shaping operations. For example, an upper working surface 162 may be planarized and/or polished. Additionally, as shown in FIG. 1G, a peripherally-extending chamfer 172 may be formed that extends between the upper working surface 162 and at least one lateral surface 164 of the infiltrated PCD table 166. The shaping operations include lapping, grinding, wire EDM, combinations thereof, or another suitable material-removal process.

Figure 1H:
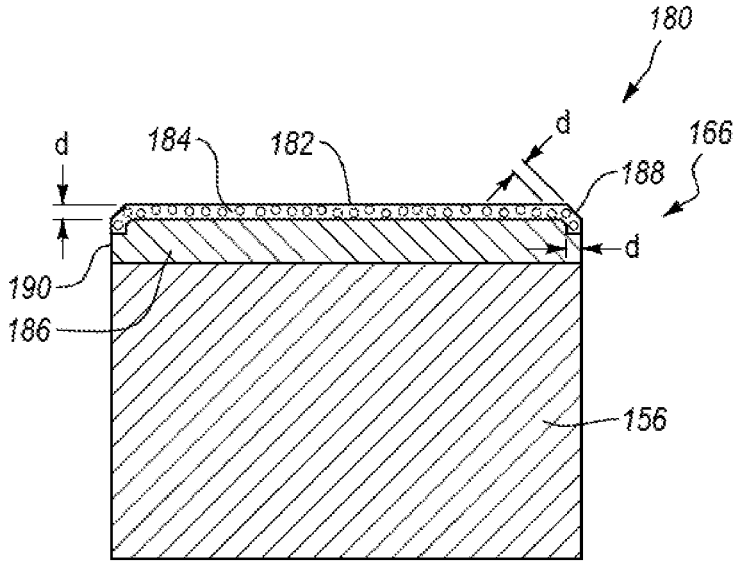

Referring to FIG. 1H, in yet a further embodiment, following infiltration, the metallic infiltrant may be removed, using any of the removing agents and methods disclosed herein by appropriately masking the PCD table 166. The masked PCD table 116 may have the metallic infiltrant removed to a selected depth "d" measured from one or more of the upper surface 182, the chamfer 188, or the at least one lateral surface 190. Removing the metallic infiltrant from the masked PCD table 166 forms a porous region 184 that is depleted of the metallic infiltrant, with a non-porous region 186 located between the porous region 184 and the substrate 156. For example, the porous region 184 may generally contour the upper surface 182, the chamfer 188, and the at least one lateral surface 190. The porous region 184 may extend along a selected length of the at least one lateral surface 190. A residual amount of the metallic infiltrant may be present in the porous region 184 even after the removal process. For example, the metallic infiltrant may comprise about 0.8 wt % to about 1.50 wt % and, more particularly, about 0.9 weight % to about 1.2 wt % of the porous region 184.

Figure 1I:
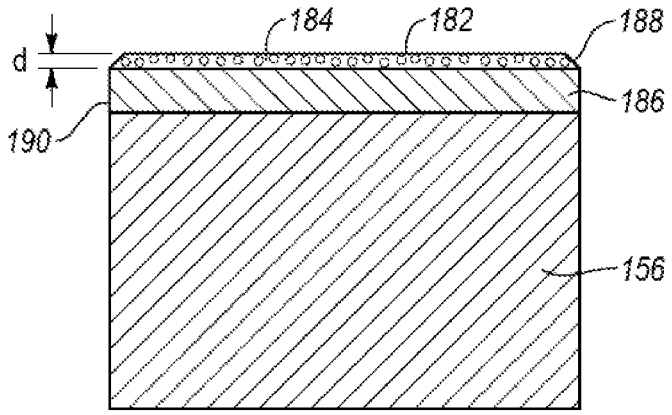
Figure 1J:
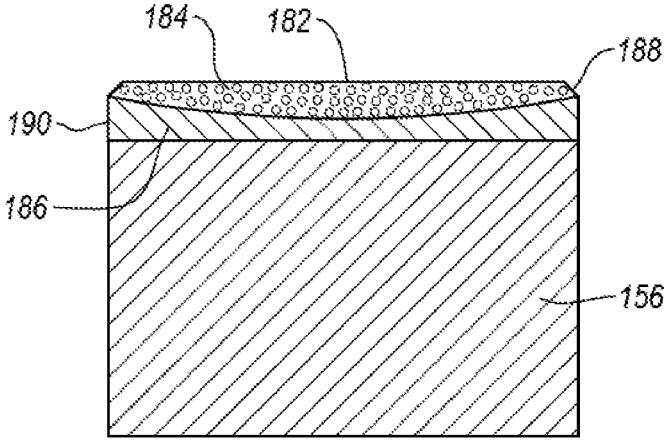

Other porosity profiles may be formed besides the porosity profile shown in FIG. 1H by appropriately masking the PCD table 166 adjacent to the bottom of the chamfer 172 as shown hereinafter in FIG. 2C. For example, as shown in FIG. 1I, the porous region 184 may be substantially uniform having a relatively uniform depth d. As another example, as shown in FIG. 1J, the porous region 184 may exhibit a non-uniform leach depth profile that is deepest near a center of the PCD table 166. Examples of non-uniform porosity depth profiles are also disclosed in U.S. Pat. No. 8,596,387, which is incorporated herein, in its entirety, by this reference.

Figure 2A:
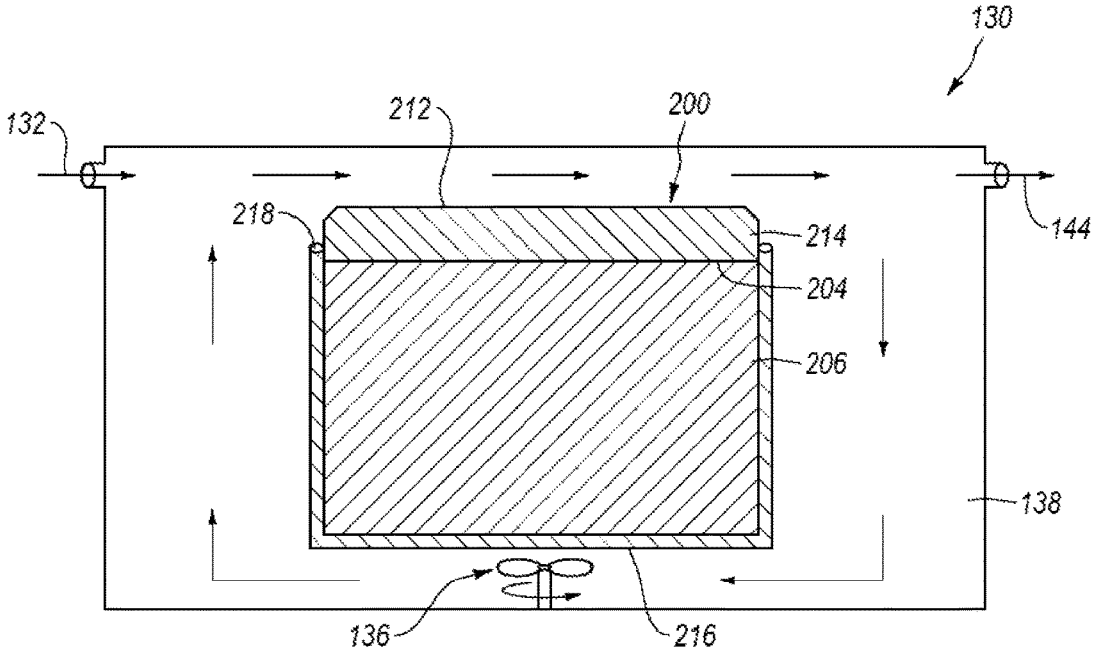
FIGS. 2A and 2B are cross-sectional views illustrating different stages in a method of leaching a PCD table of a PDC using a removing agent including at least one supercritical fluid component according to an embodiment.
Figure 2B:
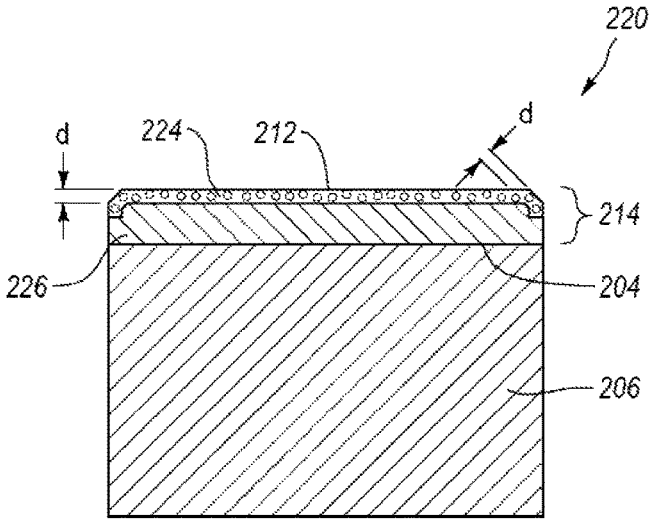

Referring to FIGS. 2A and 2B, in an embodiment, the removal processes disclosed herein may be used on a PDC 200 including a PCD table 214 that has been integrally formed with a substrate 206. For example, the PDC 200 may be made in the same manner as the PDC 120 shown in FIG. 1B, but is illustrated with the PCD table 214 having a chamfer 172. Referring now to FIG. 2A, the catalyst of the PCD table 214 may be removed to a selected leach depth "d" measured from an upper working surface 212 using a removing agent 132 including at least one supercritical fluid component. In an embodiment, the PCD table 214 may be enclosed in the extraction apparatus 130, as illustrated in FIG. 2A, containing a flow of the removing agent 132 (e.g., an emulsion of the at least one supercritical fluid component and optional aqueous component and optional chelating agent) to remove the catalyst from the PCD table 214 to form a porous region 224, shown in FIG. 2B. The porous region 224 may be substantially free of the catalyst and remote from the substrate 206. A non-porous region 226, proximate to the substrate 206, is relatively unaffected by the removal process and includes the catalyst therein. In some embodiments, the PCD table 214 may be chamfered (as shown in FIGS. 2A and 2B) before being subjected to the removal process shown in FIG. 2A, or may be un-chamfered as with the PDC 120 shown in FIG. 1B (and further discussed hereinbelow).

As shown in FIG. 2A, in an embodiment, the PDC 200 may be at least partially surrounded by a protective layer 216. At least a portion of the PDC 200, including the substrate 206, may be surrounded by the protective layer 216, and a protective ring 218. For example, the protective layer 216 may comprise an inert cup and the protective ring 218 may comprise an O-ring or other gasket, as shown in FIG. 2A. The combination of the protective layer 216 and the protective ring 218 may limit or prevent the removing agent including a supercritical fluid component 132 from substantially chemically damaging certain portions of the PDC 200, such as the substrate 206 and/or a selected portion of the PCD table 214 during the removal process. The protective layer 216 and protective ring 218 may be selectively formed over the substrate 206 and a selected portion of the PCD table 214 in varied patterns, designs, or as otherwise desired, without limitation. Such a configuration may provide selective removal of the interstitial material from the PCD table 214.

In another embodiment, selected portions of the PCD table 214 may be subjected to a masking treatment to mask areas that are desired to remain unaffected by the removal process, such as portions of the un-porous region 226 at and/or near the substrate 206. For example, electrodeposition or plasma deposition of a nickel alloy (e.g., a suitable Inconel® alloy), a suitable metal, or a metallic alloy covering the substrate 206 and the non-porous region 226 may be used to limit the removal process to the desired directed area of the porous region 224. In other embodiments, protective leaching trays and cups (not shown in FIG. 2A) for protecting portions of the PCD table 214 and the substrate 206 from removing agents during the removal process may be used. Such methods are disclosed in U.S. Patent Application No. 61/523,659 filed on 15 Aug. 2011, which is incorporated herein, in its entirety, by this reference.

FIG. 2B is a cross-sectional view of the PDC 200 subjected to the removal methods as described above with respect to FIG. 2A. In an embodiment, the porosity depth, d, to which the porous region 224 extends may be greater than about 200 μm. In another embodiment, the porosity depth, d, may be about 50 μm to about 800 μm. In another embodiment, the porosity depth, d, may be about 400 μm to about 800 μm. In another embodiment, the catalyst of the PCD table 214 may be removed so that the porosity depth, d, may be approximately equal to a thickness of the PCD table 214.

Figure 2C:
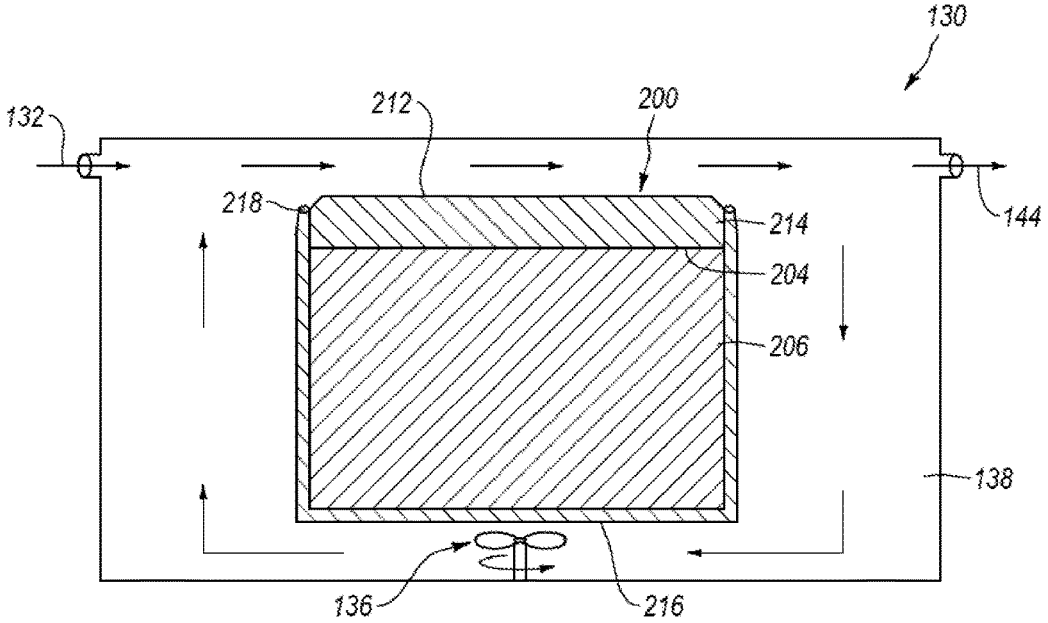
FIGS. 2C and 2D are cross-sectional views illustrating different stages in a method of leaching a PCD table of a PDC using a removing agent including at least one supercritical fluid component according to another embodiment.
Figure 2D:
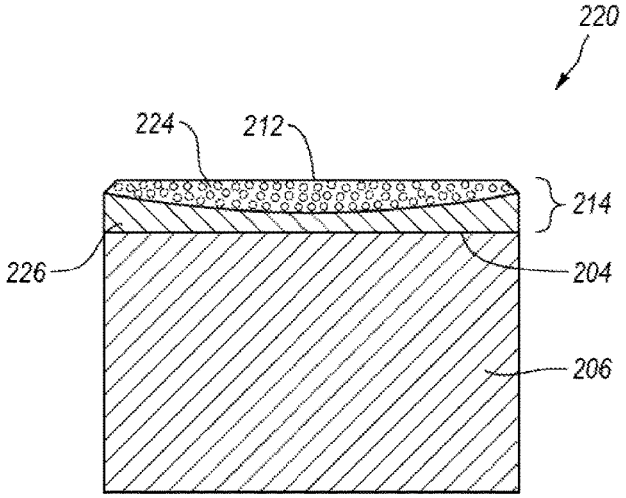

As shown in FIG. 2C, in other embodiments, the protective layer 216 and the protective ring 218 may extend further along the PCD table 214 toward the upper working surface 212. For example, the protective ring 218 may be positioned immediately adjacent to a bottom of the chamfer formed in the PCD table 214. FIG. 2D is a cross-sectional view of the PDC 200 shown in FIG. 2C after being subjected to the removal methods as described above with respect to FIG. 2A. As shown in FIG. 2D, the porous region 224 exhibits a non-uniform depth profile that is deepest near the center of the PCD table 214. Examples of non-uniform porosity depth profiles are also disclosed in U.S. Pat. No. 8,596,387.

Figure 3:
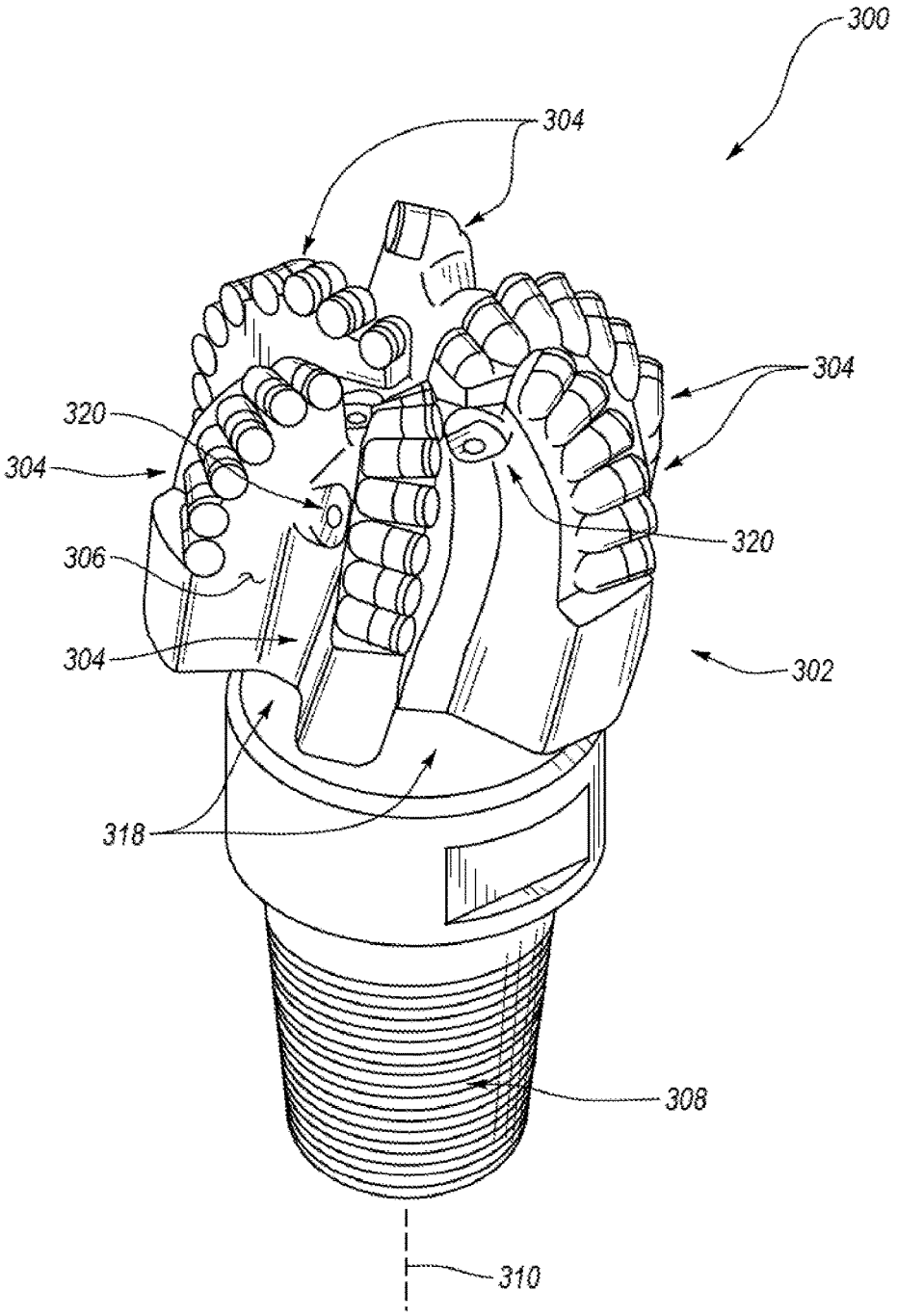
FIG. 3 is an isometric view of a rotary drill bit according to an embodiment that may employ one or more of the PDCs fabricated according to any of the embodiments disclosed herein.
Figure 4:
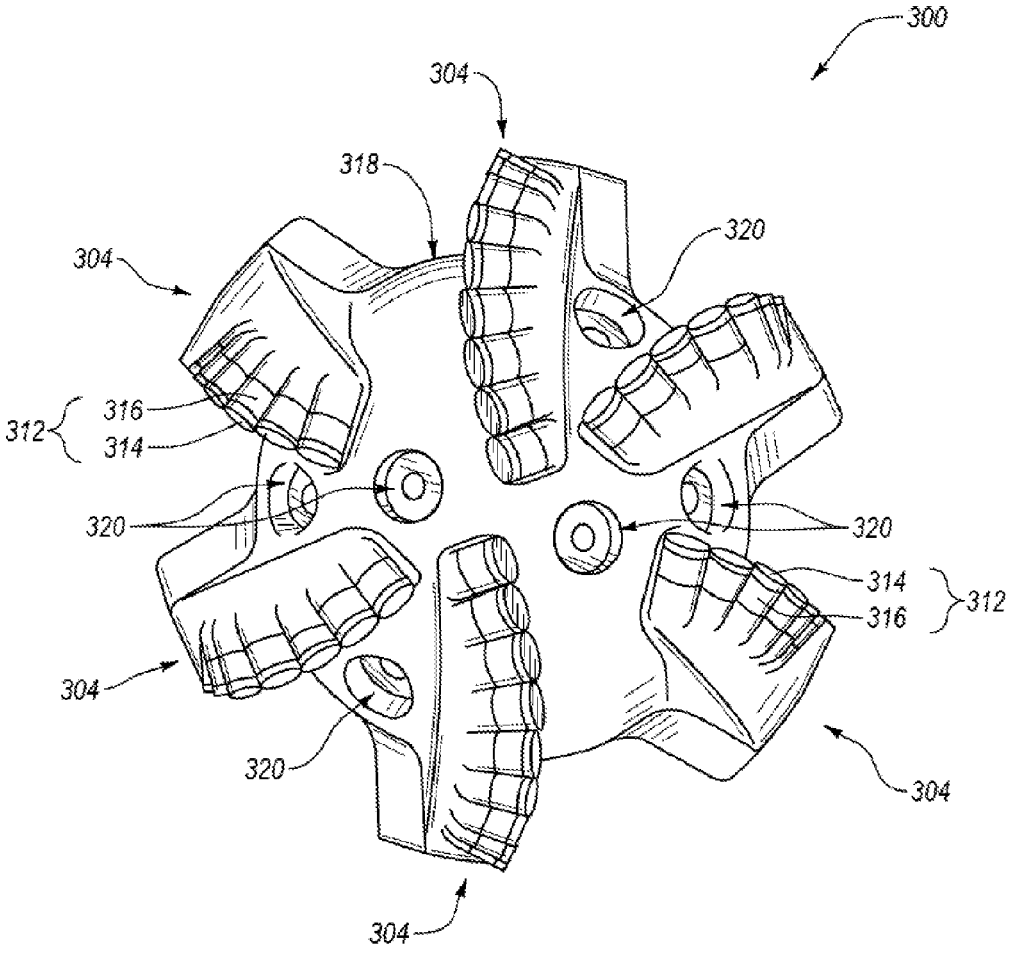
FIG. 4 is a top elevation view of the rotary drill bit shown in FIG. 3.

FIG. 3 is an isometric view and FIG. 4 is a top elevation view of a rotary drill bit 300 according to an embodiment. The rotary drill bit 300 includes at least one PDC fabricating according to any of the previously described PDC embodiments. The rotary drill bit 300 comprises a bit body 302 that includes radially and longitudinally extending blades 304 with leading faces 306, and a threaded pin connection 308 for connecting the bit body 302 to a drilling string. The bit body 302 defines a leading end structure configured for drilling into a subterranean formation by rotation about a longitudinal axis 310 and application of weight-on-bit. At least one PDC cutting element, manufactured and configured according to any of the previously described PDC embodiments (e.g., the PDC 180 shown in FIG. 1H or the PDC 220 shown in FIG. 2B), may be affixed to rotary drill bit 300 by, for example, brazing, mechanical affixing, or another suitable technique. With reference to FIG. 4, each of a plurality of PDCs 312 is secured to the blades 304. For example, each PDC 312 may include a PCD table 314 bonded to a substrate 316. More generally, the PDCs 312 may comprise any PDC disclosed herein, without limitation. In addition, if desired, in an embodiment, a number of the PDCs 312 may be conventional in construction. Also, circumferentially adjacent blades 304 define so-called junk slots 318 therebetween, as known in the art. Additionally, the rotary drill bit 300 includes a plurality of nozzle cavities 320 for communicating drilling fluid from the interior of the rotary drill bit 300 to the PDCs 312.

FIGS. 3 and 4 merely depict one embodiment of a rotary drill bit that employs at least one cutting element comprising a PDC fabricated and structured in accordance with the disclosed embodiments, without limitation. The rotary drill bit 300 is used to represent any number of earth-boring tools or drilling tools, including, for example, core bits, roller-cone bits, fixed-cutter bits, eccentric bits, bicenter bits, reamers, reamer wings, mining rotary drill bits, or any other downhole tool including PDCs, without limitation.

The PDCs disclosed herein may also be utilized in applications other than rotary drill bits. For example, the disclosed PDC embodiments may be used in thrust-bearing assemblies, radial bearing assemblies, wire-drawing dies, artificial joints, machining elements, PCD windows, and heat sinks.

Figure 5:
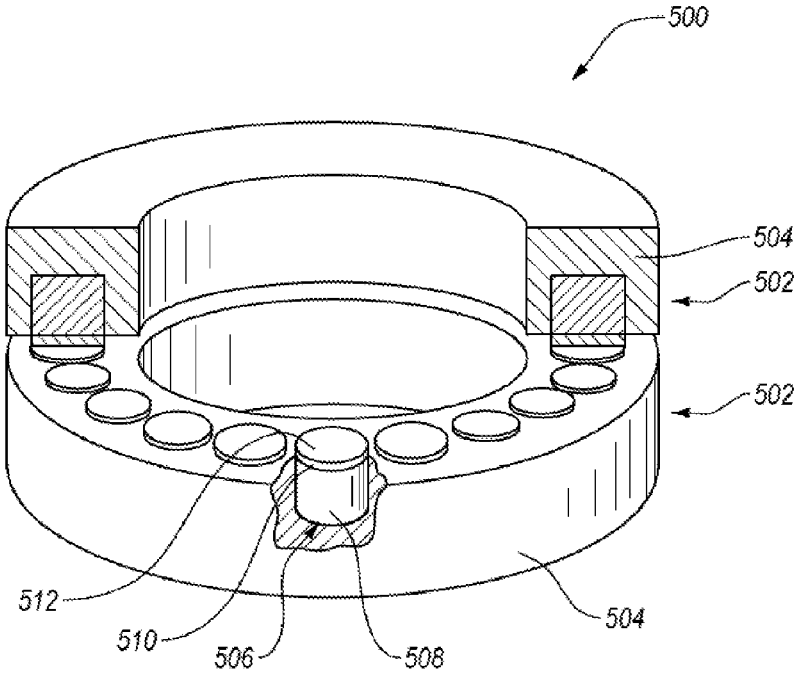
FIG. 5 is an isometric cut-away view of a thrust-bearing apparatus according to an embodiment, which may utilize any of the disclosed PDC fabricated according to any of the embodiments disclosed herein as bearing elements.

FIG. 5 is an isometric cut-away view of a thrust-bearing apparatus 500 according to an embodiment, which may utilize any of the disclosed PDC embodiments as bearing elements. The thrust-bearing apparatus 500 includes respective thrust-bearing assemblies 502. Each thrust-bearing assembly 502 includes an annular support ring 504 that may be fabricated from a material, such as carbon steel, stainless steel, or another suitable material. Each support ring 504 includes a plurality of recesses (not labeled) that receives a corresponding bearing element 506. Each bearing element 506 may be mounted to a corresponding support ring 504 within a corresponding recess by brazing, press-fitting, using fasteners, combinations thereof, or another suitable mounting technique. One or more, or all of bearing elements 506 may be manufactured and configured according to any of the disclosed PDC embodiments. For example, each bearing element 506 may include a substrate 508 and a PCD table 510, with the PCD table 510 including a bearing surface 512.

In use, the bearing surfaces 512 of one of the thrust-bearing assemblies 502 bears against the opposing bearing surfaces 512 of the other one of the bearing assemblies 502. For example, one of the thrust-bearing assemblies 502 may be operably coupled to a shaft to rotate therewith and may be termed a "rotor." The other one of the thrust-bearing assemblies 502 may be held stationary and may be termed a "stator."

Figure 6:
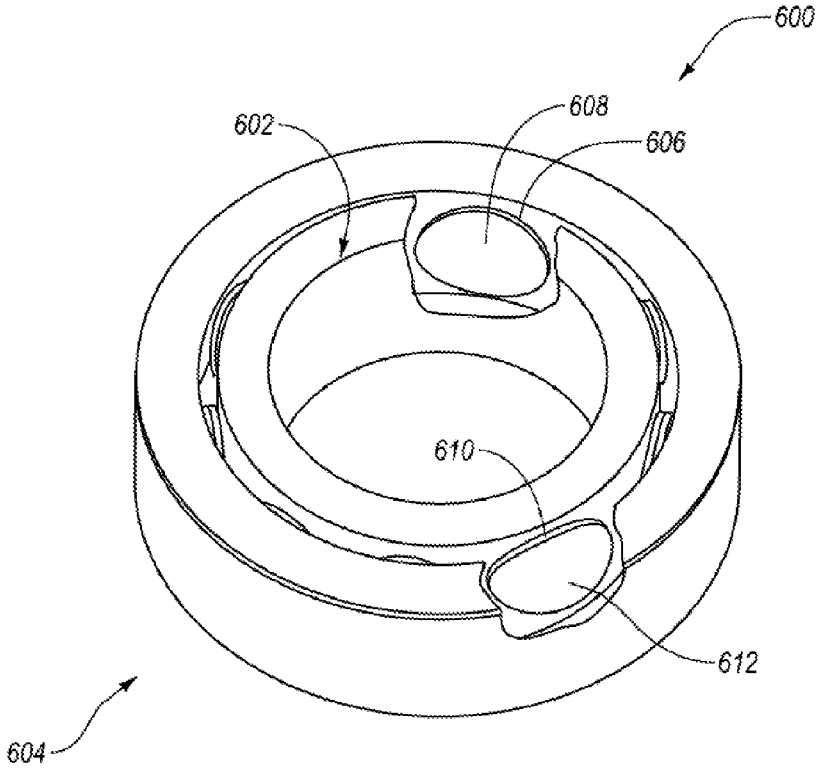
FIG. 6 is an isometric cut-away view of a radial bearing apparatus according to an embodiment, which may utilize any of the disclosed PDC fabricated according to any of the embodiments disclosed herein as bearing elements.

FIG. 6 is an isometric cut-away view of a radial bearing apparatus 600 according to an embodiment, which may utilize any of the disclosed PDC embodiments as bearing elements. The radial bearing apparatus 600 includes an inner race 602 positioned generally within an outer race 604. The outer race 604 includes a plurality of bearing elements 606 affixed thereto that have respective bearing surfaces 608. The inner race 602 also includes a plurality of bearing elements 610 affixed thereto that have respective bearing surfaces 612. One or more, or all of the bearing elements 606 and 610 may be configured according to any of the PDC embodiments disclosed herein. The inner race 602 is positioned generally within the outer race 604, with the inner race 602 and outer race 604 configured so that the bearing surfaces 608 and 612 may at least partially contact one another and move relative to each other as the inner race 602 and outer race 604 rotate relative to each other during use.

The following prophetic examples provide further detail in connection with some of the specific embodiments described above.

PROPHETIC EXAMPLE 1

A leached PCD table is formed according to the following process. Diamond particles having an average particle size of about 19 μm are provided. The diamond particles are placed adjacent to a cobalt-cemented tungsten carbide substrate. The diamond particles and substrate are positioned within a pyrophyllite cube, and HPHT processed at a temperature of about 1400° C. and a pressure of at least about 7.5 GPa cell pressure in a high-pressure cubic press to form a PCD table that bonds to the cobalt-cemented tungsten carbide substrate. During HPHT process, cobalt from the cobalt-cemented tungsten carbide substrate infiltrates into the diamond particles and promotes diamond-to-diamond bonding between the diamond particles. The cobalt-cemented tungsten carbide substrate is removed from the PCD table after HPHT processing by grinding.

The cobalt is removed from separated PCD table using a removing agent including supercritical carbon dioxide, an aqueous solution including hydrochloric and nitric acid, a bis-(2-ethylhexyl) sulfosuccinate chelating agent, a perfluoropolyether phosphate additive, and water. The separated PCD table is enclosed in a suitable extraction apparatus, while a flow of the removing agent is provided. The extraction apparatus is heated to about 40° C. and a pressure of about 3000 psi. The removing agent is stirred for 1 hour to form a microemulsion.

PROPHETIC EXAMPLE 2

A separated PCD table is formed using the same process described in Prophetic Example 1. The cobalt is removed from the separated PCD table using a removing agent that includes supercritical carbon dioxide, an aqueous solution including hydrochloric and nitric acid, a 4,4'-dimethyl-2,2'-bipyridyl chelating agent, and a perfluoro-1-octane-sulfonic acid tetraethylammonium salt additive. The separated PCD table is enclosed in a suitable extraction apparatus, while a flow or removing agent is provided. The extraction apparatus is heated to about 50° C., a pressure of about 3600 psi and is stirred for 20 minutes.

PROPHETIC EXAMPLE 3

A separated PCD table is formed using the same process described in Prophetic Example 1. The cobalt is removed from the separated PCD table using a removing agent that includes supercritical carbon dioxide, a heptane additive, an aqueous solution including hydrochloric and nitric acid, a 2-ethyl hexyl 2-ethyl hexyl phosphonic acid chelating agent, and water. The chelating agent was mixed with the supercritical heptane in an amount of about 2.5 volume %. The separated PCD table is enclosed in a suitable extraction apparatus, while 1 ml/min flow of the supercritical carbon dioxide and 0.2 ml/min flow of the heptane is provided. The extraction apparatus is heated to about 40° C. and a pressure of about 1425 psi.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of fabricating an at least partially porous polycrystalline diamond body, the method comprising:

providing a polycrystalline diamond body including a plurality of bonded diamond grains defining a plurality of interstitial regions having at least one interstitial constituent disposed therein; and at least partially removing the at least one interstitial constituent from the polycrystalline diamond body with a removing agent to form an at least partially porous polycrystalline diamond body, wherein the removing agent includes at least one supercritical fluid component.

2. The method of claim 1, further comprising bonding the at least partially porous polycrystalline diamond body to a substrate to form a polycrystalline diamond compact.

3. The method of claim 1 wherein the at least one supercritical fluid includes at least one member selected from the group consisting of carbon dioxide, water, methane, ethane, propane, ethylene, propylene, methanol, ethanol, acetone, pentane, butane, hexamine, heptane, sulfur hexafluoride, xenon dichlorodifluoromethane, trifluoromethane, isopropanol, nitrous oxide, ammonia, methylamine, and diethyl ether.

4. The method of claim 1 wherein the removing agent is substantially free of an aqueous component.

5. The method of claim 1 wherein the removing agent includes a leaching agent that includes an aqueous component.

6. The method of claim 5 wherein the aqueous component includes hydrofluoric acid, nitric acid, hydrochloric acid, aqua regia, or combinations thereof.

7. The method of claim 5 wherein the leaching agent includes at least one chelating agent.

8. The method of claim 7 wherein the at least one chelating agent includes at least one member selected from the group consisting of an amphiphilic surfactant, an organic solvent, a dithiocarbamate, 2-ethyl hexyl 2-ethyl hexyl phosphonic acid, a 2-ethyl sodium bis-(2-ethyl hexyl)sulfosuccinate, crown ethers, β-diketones, fluorinated deketones; a fluorinated sodium bis-(2-ethyl hexyl)sulfosuccinate a 2,2'-bipyridine and its derivatives (e.g., 4,4'-dimehtyl-2,2'-bipyridyl), a perfluoropolyether phosphate, perfluro-1-octanesulfonic acid tetraethylammonium salt, and a fluorinated surfactant including a fluorocarbon tail.

9. The method of claim 7 wherein the at least one chelating agent acts as a surfactant that aids in the formation of a microemulsion supercritical fluid.

10. The method of claim 7, further comprising stirring the leaching agent so that the at least one supercritical component and the at least one chelating agent form an emulsion.

11. The method of claim 10 wherein stirring the leaching agent so that the at least one supercritical component and the at least one chelating agent form an emulsion includes stirring the leaching agent for a period of less than about 1.5 hours.

12. The method of claim 10 wherein the emulsion is substantially homogeneously dispersed.

13. The method of claim 1 wherein at least partially removing the at least one interstitial constituent from the polycrystalline diamond body with the removing agent includes:

placing the polycrystalline diamond body in an extraction apparatus; and heating and pressurizing the extraction apparatus containing the polycrystalline diamond body and the removing agent sufficiently to at least partially remove the interstitial constituent from the polycrystalline diamond body.

14. The method of claim 13 wherein the extraction apparatus is heated to a temperature of less than about 400° C.

15. The method of claim 13 wherein the extraction apparatus is pressurized to a pressure of less than about 3500 psi.

16. The method of claim 13 wherein the extraction apparatus is a closed system or an open system.

17. The method of claim 1 wherein the interstitial constituent is includes at least one of a catalyst or a metallic infiltrant.

18. A method of forming a polycrystalline diamond compact, the method comprising:

forming a polycrystalline diamond body having a catalyst dispersed therethrough;

positioning the polycrystalline diamond body in an extraction apparatus;

flowing a leaching agent into the extraction apparatus, wherein the leaching agent includes a supercritical fluid component, an aqueous component, and at least one chelating agent;

stirring the leaching agent in the extraction apparatus to form an emulsion;

at least partially leaching the polycrystalline diamond body with the emulsion to at least partially remove the metal-solvent catalyst from the polycrystalline diamond body;

infiltrating the at least partially leached polycrystalline diamond body with a metallic infiltrant under conditions effective to bond the infiltrated polycrystalline diamond body to the substrate to form the polycrystalline diamond compact; and removing at least a portion of the metallic infiltrant from the infiltrated polycrystalline diamond body of the polycrystalline diamond compact by flowing additional leaching agent across a working surface of the infiltrated polycrystalline diamond body, wherein the additional leaching agent includes a supercritical fluid component and an aqueous component.

19. The method of claim 18 wherein the supercritical fluid component of the leaching agent and the additional leaching agent includes at least one member selected from the group consisting of carbon dioxide, supercritical carbon dioxide, water, methane, ethane, propane, ethylene, propylene, methanol, ethanol, acetone, pentane, butane, hexamine, heptane, sulfur hexafluoride, xenon dichlorodifluoromethane, trifluoromethane, isopropanol, nitrous oxide, ammonia, methylamine, and diethyl ether.

20. The method of claim 18 wherein the aqueous component of the leaching agent and the additional leaching agent includes hydrofluoric acid, nitric acid, hydrochloric acid, aqua regia, or combinations thereof and the at least one chelating agent includes at least one member selected from the group consisting of an amphiphilic surfactant, an organic solvent, a dithiocarbamate, 2-ethyl hexyl 2-ethyl hexyl phosphonic acid, a 2-ethyl sodium bis-(2-ethyl hexyl)sulfosuccinate, crown ethers, β-diketones, fluorinated deketones; a fluorinated sodium bis-(2-ethyl hexyl)sulfosuccinate a 2,2'-bipyridine and its derivatives (e.g., 4,4'-dimehtyl-2,2'-bipyridyl), a perfluoropolyether phosphate, perfluro-1-octanesulfonic acid tetraethylammonium salt, and a fluorinated surfactant including a fluorocarbon tail.

21. The method of claim 18 wherein stirring the leaching agent of the leaching agent and the additional leaching agent in the extraction apparatus to form an emulsion includes stirring the leaching agent for a time of less than about 1.5 hours.

22. The method of claim 17 wherein removing at least a portion of the metallic infiltrant from the infiltrated polycrystalline diamond body of the polycrystalline diamond compact by flowing additional leaching agent across a working surface of the infiltrated polycrystalline diamond body includes leaching a portion of the metallic infiltrant present in the infiltrated polycrystalline diamond body to a selected leach depth of about 50 μm to about 800 μm.

23. A method of fabricating a polycrystalline diamond compact, the method comprising:

providing a polycrystalline diamond body including a plurality of bonded diamond grains defining a plurality of interstitial regions having at least one interstitial constituent disposed therein;

at least partially removing the at least one interstitial constituent from the polycrystalline diamond body with a removing agent to form an at least partially porous polycrystalline diamond body, wherein the removing agent includes at least one supercritical fluid component; and bonding the at least partially porous polycrystalline diamond body to a substrate to form the polycrystalline diamond compact.

24. The method of claim 1 wherein the removing agent includes a leaching agent having an aqueous component composed to dissolve the at least one interstitial constituent in solution as metal ions.

25. The method of claim 1 wherein the at least one interstitial constituent includes tungsten.

26. The method of claim 1 wherein:

the at least one interstitial constituent includes tungsten; and the removing agent includes a leaching agent having an aqueous component composed to dissolve the at least one interstitial constituent, including at least some of the tungsten therein, in solution as metal ions.

* * * * *